US010940491B1

(12) United States Patent
Patrick et al.

(10) Patent No.: US 10,940,491 B1
(45) Date of Patent: Mar. 9, 2021

(54) CENTRIFUGE OPERATING WITH SINUSOIDAL MOTION

(71) Applicant: SPHERICAL HOLDINGS, LLC, Los Angeles, CA (US)

(72) Inventors: David M. Patrick, Ladera Ranch, CA (US); Robert S. Patrick, Plano, TX (US)

( * ) Notice: Subject to any disclaimer, the term of this patent is extended or adjusted under 35 U.S.C. 154(b) by 499 days.

(21) Appl. No.: 15/963,039

(22) Filed: Apr. 25, 2018

(51) Int. Cl.
*B04B 9/12* (2006.01)
*B04B 5/00* (2006.01)

(52) U.S. Cl.
CPC . *B04B 9/12* (2013.01); *B04B 5/00* (2013.01)

(58) Field of Classification Search
CPC .... B04B 9/12; B04B 5/00; G09B 9/10; G09B 9/12
USPC ..... 494/43, 47, 84
See application file for complete search history.

(56) References Cited

U.S. PATENT DOCUMENTS 5,052,932 A * 10/1991 Trani ..... G09B 9/32 434/29
6,019,006 A 2/2000 Schofield
7,819,793 B2 10/2010 Lindell et al.
2012/0312494 A1 12/2012 Ciardullo

FOREIGN PATENT DOCUMENTS

EP 0 838 265 A2 4/1998
GB 2543815 A 5/2017

OTHER PUBLICATIONS

WO, PCT/US2019/029190 ISR and Written Opinion, dated Jan. 30, 2020.

* cited by examiner

*Primary Examiner* — Walter D. Griffin
*Assistant Examiner* — Shuyi S. Liu
(74) *Attorney, Agent, or Firm* — Cionca IP Law P.C.; Marin Cionca

(57) ABSTRACT

A spherical centrifuge has a sinusoidal track engaged on its surface, the track circling the surface following a great circle of said centrifuge. A mechanical drive engages the track enabling rotation of the centrifuge. The track may have a constant sinusoidal amplitude and a constant sinusoidal period. The centrifuge may have an interior space and a portal into the interior space. The interior space may have any shape. The centrifuge rotates about its diameter while also reciprocating in rolling motion lateral to its forward rotational direction by following the sinusoidal track.

19 Claims, 3 Drawing Sheets

CENTRIFUGE OPERATING WITH SINUSOIDAL MOTION

FIELD OF THE DISCLOSURE

The field of this disclosure is related to centrifuge apparatus for separation of fluids by the use of centripetal forces.

BACKGROUND

Generally, a centrifuge is an apparatus that puts an object in rotation around a fixed axis, applying a potentially strong radial force perpendicular to the axis of spin. The centrifuge works using the sedimentation principle, where centripetal acceleration causes denser substances and particles that are held within the spinning container, to move outward in the radial direction. At the same time, objects that are less dense are displaced and forced toward the axis of spin. In a laboratory centrifuge that uses sample tubes, the radial acceleration causes denser particles to settle to the bottom of the tube, while low-density substances rise to the top. There are three types of centrifuge designed for different applications. Industrial scale centrifuges are commonly used in manufacturing and waste processing to sediment suspended solids, or to separate immiscible liquids. An example is the cream separator found in dairies. Very high-speed centrifuges and ultracentrifuges are able to provide very high accelerations separating fine particles down to the nanoscale, and also molecules of different masses. Gas centrifuges are used for isotope separation, such as to enrich nuclear fuel to obtain fissile isotopes.

A wide variety of laboratory-scale centrifuges are used in chemistry, biology, biochemistry and clinical medicine for isolating and separating suspensions and various fluid substances. They vary widely in speed, capacity, temperature control, and other characteristics. Laboratory centrifuges often can accept a range of different fixed-angle and swinging bucket rotors able to carry different numbers of centrifuge tubes and rated for specific maximum speeds. Controls vary from simple electrical timers to programmable models able to control acceleration and deceleration rates, running speeds, and temperature regimes. Ultracentrifuges spin rotors under vacuum, eliminating air resistance and enabling exact temperature control. Zonal rotors and continuous flow systems are capable of handing bulk and larger sample volumes, respectively, in a laboratory-scale instrument. An important application in medicine is blood separation. Blood separates into cells and proteins (RBC, WBC, platelets, etc.) and serum. DNA preparation is another common application for pharmacogenetics and clinical diagnosis. DNA samples are purified and the DNA is prepped for separation by adding buffers and then centrifuging it for a certain amount of time. The blood waste is then removed and another buffer is added and spun inside the centrifuge again. Once the blood waste is removed and another buffer is added the pellet can be suspended and cooled. Proteins can then be removed and with further centrifuging DNA may be isolated completely. Protocols for centrifugation typically specify the amount of acceleration to be applied to the sample, rather than specifying a rotational speed, i.e., revolutions per minute. This distinction is important because two rotors with different diameters running at the same rotational speed will subject samples to different acceleration forces. In circular motion, acceleration is the product of radial distance, the square of angular velocity and the acceleration relative to "g" the standard acceleration due to gravity. The acceleration is normally expressed in multiples of "g" a dimensionless quantity.

BRIEF DESCRIPTION OF THE DRAWINGS

Embodiments of the described apparatus are illustrated only as examples in the figures of the accompanying drawing sheets wherein the same element appearing in various figures is referenced by a common reference mark.

DETAILED DESCRIPTION

Figure 1:
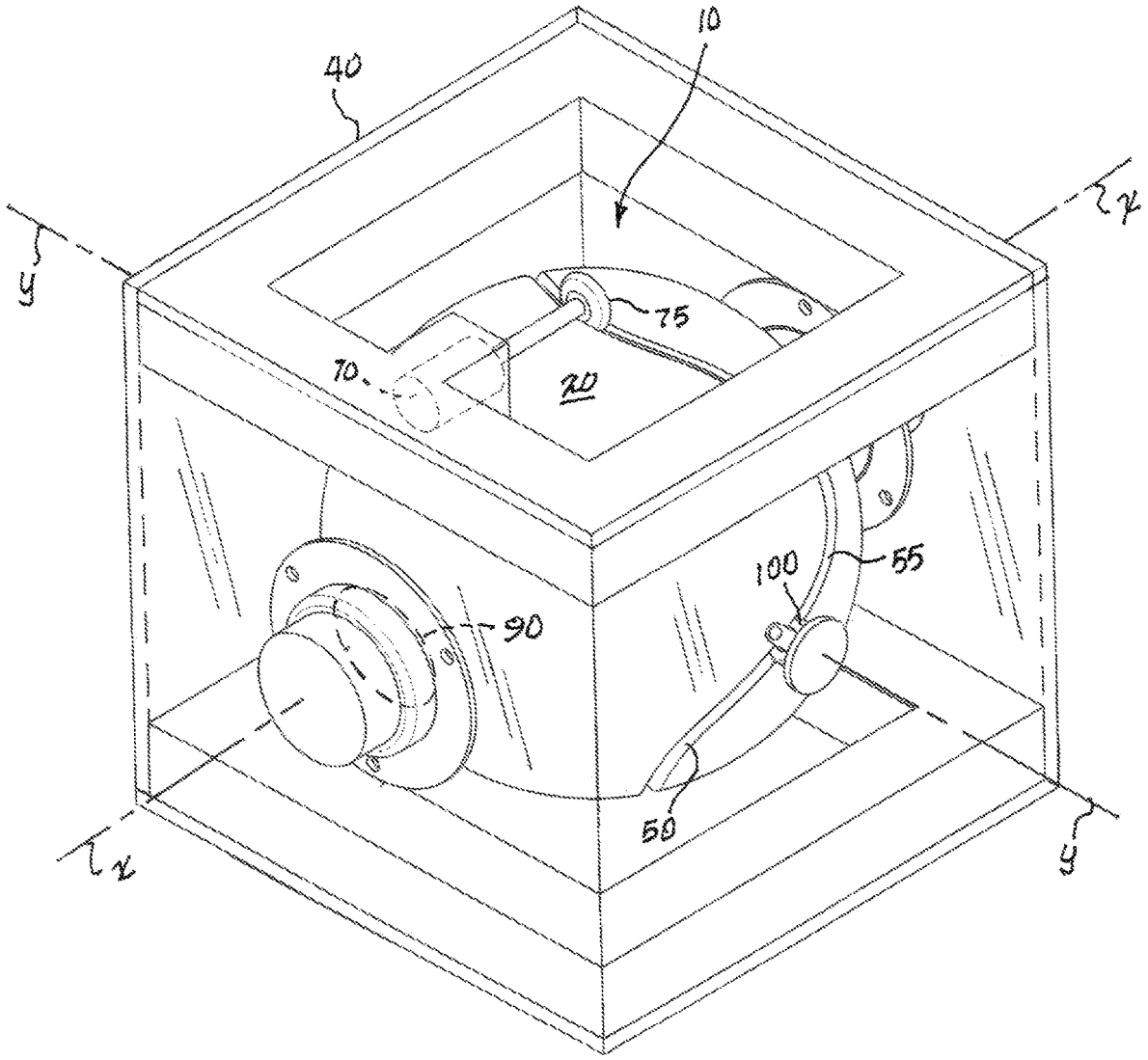
FIG. 1 is a perspective illustration of the invention, a centrifuge, showing a left side, a front side and a top side thereof.
Figure 2:
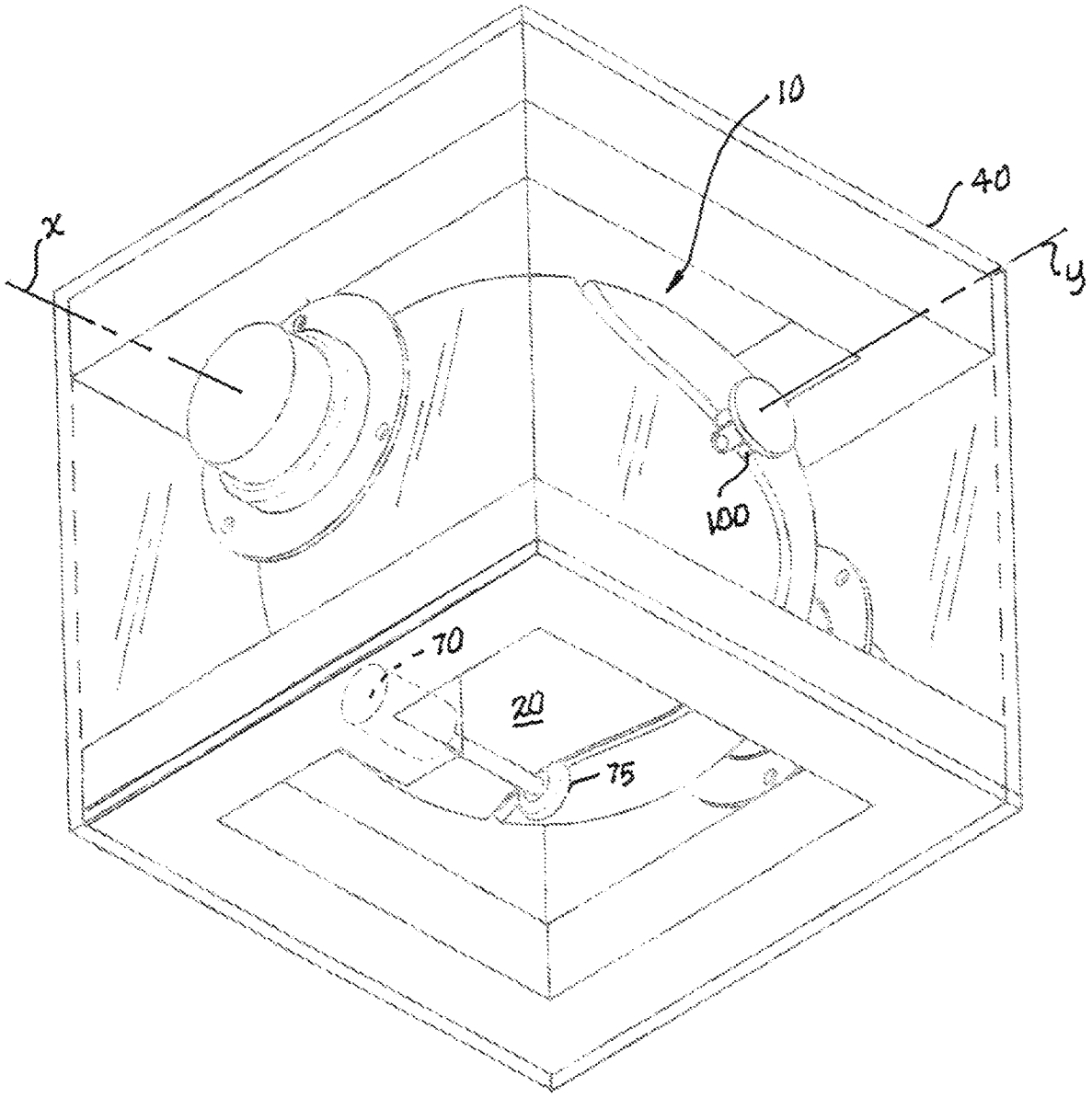
FIG. 2 is a further perspective illustration thereof showing a right side, a rear side and a bottom side thereof.

The invention is a centrifuge 10 as shown in FIGS. 1 and 2. Centrifuge 10 has a spherical exterior surface 20, defining a center point about which rotation occurs. Centrifuge 10 may be held by a fixture 40 which is capable of holding the center point of centrifuge 10 stationary even as centrifuge 10 rotates and reciprocates. A sinusoidal track 50 may be integral to surface 20, the track 50 being secured on top of surface 20 or impressed into surface 20 as a groove as shown, which track 50 may be a linear gear, for instance. As shown in FIG. 1 we can define an X-axis and a Y-axis relative to centrifuge 10. Sinusoidal track 50 may be centered on a great circle of centrifuge 10 wherein said great circle will lie collinear with the Y-axis; see FIG. 3. A drive motor 70 may rotate a drive wheel 75 which may be engaged with track 50 within groove 55 whereby centrifuge 10 may be caused to rotate about the X-axis, where the rotation follows the great circle.

Figure 3:
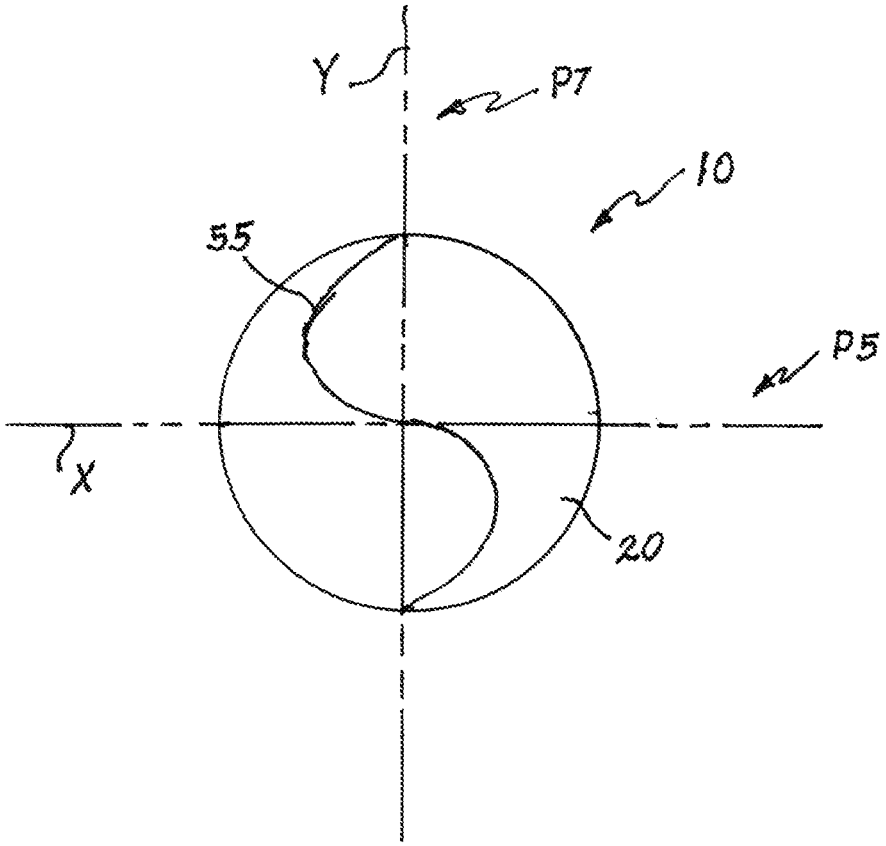
FIG. 3 is a top plan view thereof showing X and Y axes which represent planes extensive in the Z-direction.

As centrifuge 10 describes simple rotational motion along said great circle and about the X-axis, it also reciprocates side to side about the Y-axis following the sinusoidal track 50. Therefore, centrifuge 10 experiences a mixture of the simple rotation about the X-axis and reciprocating motion about the Y-axis. Because of this joint motion any material that may be enclosed within centrifuge 10 will experience centripetal forces accelerating it radially in two orthogonal planes, P5 and P7 which are defined by the X and the Y axis respectively as shown in FIG. 3. Assuming the interior of centrifuge 10 is spherical the material will form two doughnut-shaped configurations of the material which will be positioned at right angles to each other (orthogonal).

Centrifuge 10 may be enclosed and centered within cubical structure 40 as shown in FIGS. 1 and 2. As shown, opposing drive wheels 75 may be positioned within groove 55 to constrain centrifuge 10 vertically. A pair of opposing free-rolling balls 90 may be positioned against spherical exterior surface 20 in order to constrain centrifuge 10 in the X-axis direction. A pair of opposing free-rolling wheels 100 positioned within sinusoidal groove 55 may be used to constrain centrifuge 10 in the Y-axis direction. Therefore, the pair of opposing free-rolling balls 90, the pair of opposing free-rolling wheels 100, and the pair of drive wheels 75 being in mutually orthogonal orientations are able to fully constrain centrifuge 10 within cubical structure 40 while allowing it to rotate about the X-axis and oscillate or reciprocate about the Y-axis. A controller (not shown), such as a common industrial motor controller may be used to operate drive motors 75 as to their speed and operating program, as is also well known in the art.

In the foregoing description, embodiments are described as a plurality of individual parts, and methods as a plurality of individual steps and this is solely for the sake of illustration. Accordingly, it is contemplated that some additional parts or steps may be added, some parts or steps may be changed or omitted, and the order of the parts or steps may be re-arranged, while maintaining the sense and understanding of the apparatus and methods as claimed.

What is claimed is:

1. A centrifuge comprising:

a spherical exterior surface, wherein a center point of said centrifuge is positioned equidistant from all points on said spherical exterior surface;

said centrifuge held by a fixture wherein said center point is immovable;

said spherical exterior surface having a sinusoidal track therein:

a drive motor engaged with said sinusoidal track whereby said centrifuge rotates with sinusoidal motion about said center point.

2. The centrifuge of claim 1 wherein said fixture is a cubical structure with said centrifuge centered therein.

3. The centrifuge of claim 2 wherein said sinusoidal track is in the form of a groove.

4. The centrifuge of claim 3 wherein said drive motor has a drive wheel engaged within said groove.

5. The centrifuge of claim 4 wherein said drive motor has opposing drive wheels positioned within said groove.

6. The centrifuge of claim 5 wherein said fixture has a pair of opposing free-rolling balls positioned against said spherical exterior surface.

7. The centrifuge of claim 6 wherein said fixture has a pair of opposing free-rolling wheels positioned within said sinusoidal groove.

8. The centrifuge of claim 7 wherein all three of said pair of opposing free-rolling balls, said pair of opposing free-rolling wheels, and said pair of drive wheels are mutually orthogonal.

9. A method of rotating a centrifuge, the method comprising: forming said centrifuge with a spherical exterior surface, wherein a center point of said centrifuge is positioned equidistant from all points on said spherical exterior surface; securing said centrifuge within a fixture wherein said center point is immovable; placing a sinusoidal track about said spherical exterior surface; and engaging a drive motor with a groove of said sinusoidal track thereby rotating said centrifuge in sinusoidal motion about said center point.

10. The method of claim 9 further comprising centering said centrifuge within said fixture.

11. The method of claim 10 further comprising embedding said groove in said spherical exterior surface.

12. The method of claim 11 further comprising positioning said drive wheel within said groove.

13. The method of claim 12 further comprising positioning opposing drive wheels within said groove.

14. The method of claim 13 further comprising positioning a pair of opposing free-rolling balls against said spherical exterior surface.

15. The method of claim 14 further comprising positioning a pair of opposing free-rolling wheels within said groove.

16. The method of claim 15 further comprising positioning said pair of opposing free-rolling balls, said pair of opposing free-rolling wheels, and said pair of drive wheels in mutual orthogonality.

17. A centrifuge comprising:

a spherical surface having a sinusoidal track therein, said track following a great circle of said spherical surface;

a drive motor engaged with said sinusoidal track, said drive motor enabled for rotating said centrifuge about a first axis according to said great circle, and for simultaneously reciprocating said centrifuge about a second axis orthogonal to said first axis.

18. The centrifuge of claim 17 further comprising a cubic structure within which said centrifuge is rotationally secured.

19. The centrifuge of claim 18 wherein a pair of opposing free-rolling balls, a pair of opposing free-rolling wheels engaged with said track, and a pair of said drive motors are secured by said cubic structure for securing said centrifuge.

* * * * *